United States Patent [19]

Disperens

[11] 3,947,999

[45] Apr. 6, 1976

[54] SLIDING DOOR ASSEMBLY

[76] Inventor: Pierre Disperens, En Vallaire, 1024 Ecublens, Switzerland

[22] Filed: Sept. 23, 1974

[21] Appl. No.: 508,284

[30] Foreign Application Priority Data

Sept. 27, 1973 Switzerland ..... 13831/73
Sept. 11, 1974 Switzerland ..... 12337/74

[52] U.S. Cl. ..... 49/217; 49/223; 49/234
[51] Int. Cl.[2] ..... E05D 15/10
[58] Field of Search ..... 49/234, 235, 221–224, 49/216, 217, 225

[56] References Cited

FOREIGN PATENTS OR APPLICATIONS 106,783 11/1964 Denmark ..... 49/222
2,009,030 11/1971 Germany ..... 49/222

*Primary Examiner*—Kenneth Downey
*Attorney, Agent, or Firm*—Robert E. Burns; Emmanuel J. Lobato; Bruce L. Adams

[57] ABSTRACT

A sliding door assembly comprises a door, a door frame, a horizontal rolling track on the frame, and door-suspension units each having a member movably mounted along the track and a door-suspension lever pivotally connected to the member and to the door. A roller connected to the lever by a toggle joint mechanism coacts with a cam as the door is slid to or from a closed position to pivot the lever and thus raise and unseat the door as it is opened, and lower and seat the door as it is closed.

10 Claims, 5 Drawing Figures

SLIDING DOOR ASSEMBLY

The invention relates to sliding door assemblies, particularly for refrigerating installations, of the type in which when the door is in a closed position it is seated in a substantially fluid-tight manner against its frame and when the door is in an open position it is spaced apart from its frame.

Numerous assemblies of this type are known in which a rolling track along which the door slides may occupy two positions, a first one in which the door is held tight against its frame and a second open one in which the door is spaced apart from its frame. These assemblies have the disadvantage of requiring a cumbersome arrangement for mounting and moving the rolling track.

According to the invention, a sliding door assembly comprises a door, a door frame, a horizontal rolling track fixed parallel to the frame, a member movably mounted along the track, a lever pivotally connected to the member and to the door and by which the door is suspended from the track, the lever being pivotable between a first position in which the door is lowered and applied against the frame and a second position in which the door is raised and spaced apart from the frame, and means for moving the lever from its second to its first position in response to movement of the member along the track into a closed position of the door and from its first to its second position in response to movement of the member along the track from said closed position of the door.

The accompanying schematic drawings show, by way of example, two embodiments of the invention, In the drawings.

Figure 1:
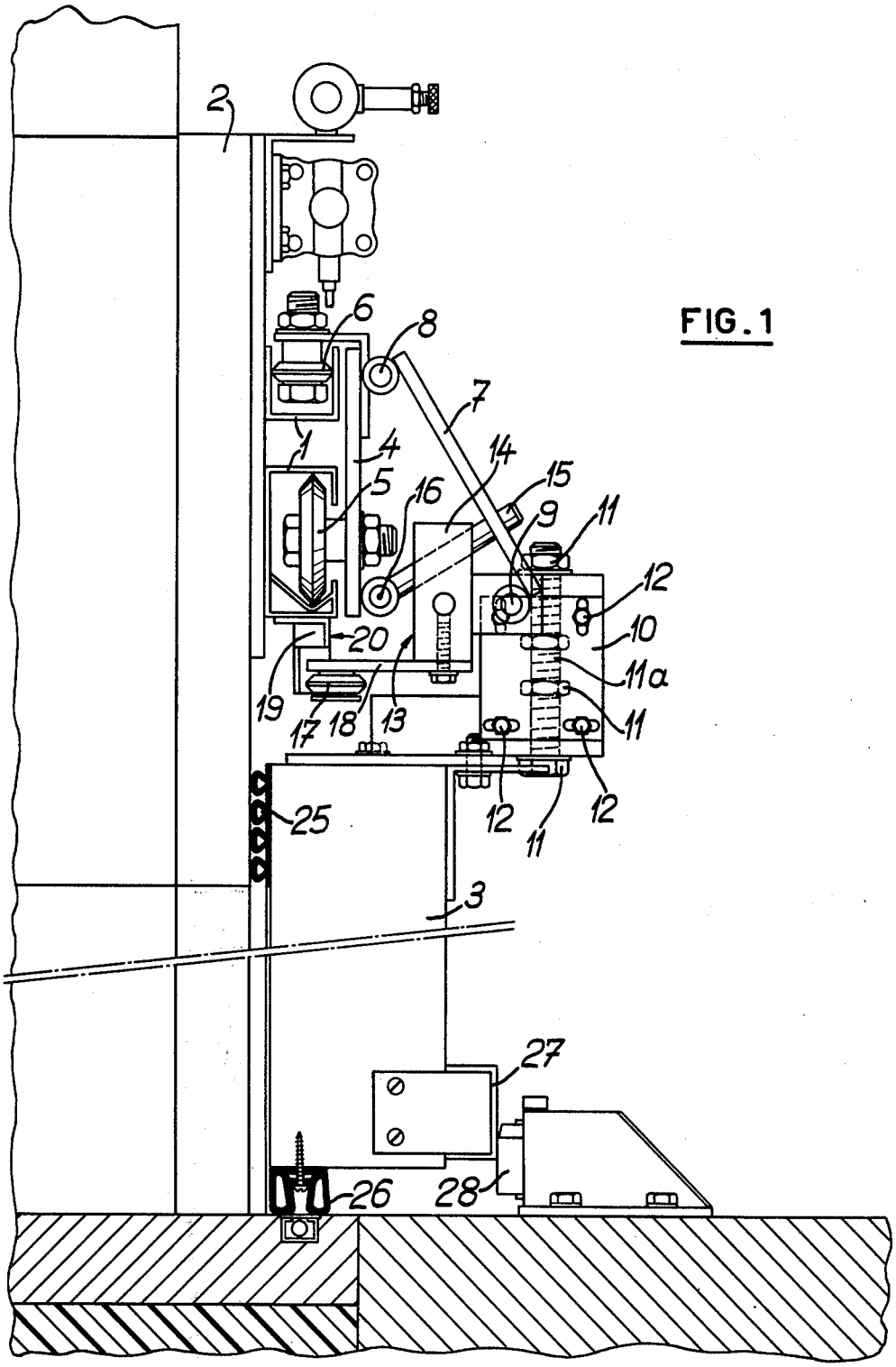
FIG. 1 is a side view of a first embodiment.

The sliding door assembly shown in FIG. 1 includes a horizontal rolling track 1 which is fixed parallel to frame 2 of door 3. A door-suspension element 4 is able to move by means of rollers 5 and 6 along the rolling track 1.

The door 3 is suspended from suspension member 4 by means of pairs of levers 7 pivotally connected at 8 to the suspension member 4 and at 9 to an adjusting unit 10 fixed on door 3. This adjusting unit 10 enables, through nuts 11 mounted on a bolt 11*a*, adjustment of the height of door 3 above the ground and, through nuts 12, adjustment of the spacing of the door 3 in relation to its frame 2, and perpendicularly of the door.

To raise the door 3 and separate it from its frame 2 during opening, there is provided on this device a linkage and transmission mechanism 13 able to pivot at 9 on the adjusting unit 10 and slidably mounted by means of a plate 14 on two rods 15 pivoted at 16 on the suspension element 4. Such a mechanism will be described in further detail with reference to FIG. 4.

A roller 17 mounted on a horizontal arm 18 fixed on plate 14 is adapted to cooperate with a cam 19 fixed on the frame to provide a displacement of roller 17 perpendicular to the plane of the frame to move the roller 17 onto a horizontal rolling track 20.

The door 3 can be opened (see FIGS. 2 and 3) by means of handles 21 which when pivoted (as indicated by the arrows) push a pin 22 against a stop block 23 to drive the door 3 in the direction of arrow 24. At this moment, the roller 17 moves over the cam 19. The movement of roller 17 is transmitted by the mechanism 13 to levers 7 and unit 10 so that the door 3 is moved away from its frame 2 and simultaneously lifted above the ground. Sealing joints 25,26 on the door 3 are thus respectively moved away from the frame and the ground and the door is free to slide. By continuing to push on the door, the roller 17 rolls on its rolling track 20 and the door is thus held lifted and spaced apart from its frame along its entire path.

Upon closing the door, when the roller 17 drops into cam 19, the door 3 follows a trajectory opposite to that during opening; it is lowered and simultaneously comes to be applied against frame 2.

To assist holding of the door against its frame there are provided at the lower end of the door 3 two cams 27 having operative plane face making an angle of about 15° with the face of door 3 and which cooperate with rollers 28 fixed on the ground in a manner to strongly apply the door 3 against the frame 2 in the closed position.

The door may be opened manually; this manoeuvre is advantageously assisted by a jack 30 controlled either by the handles 21 of by means forming no part of the door.

Figure 2:
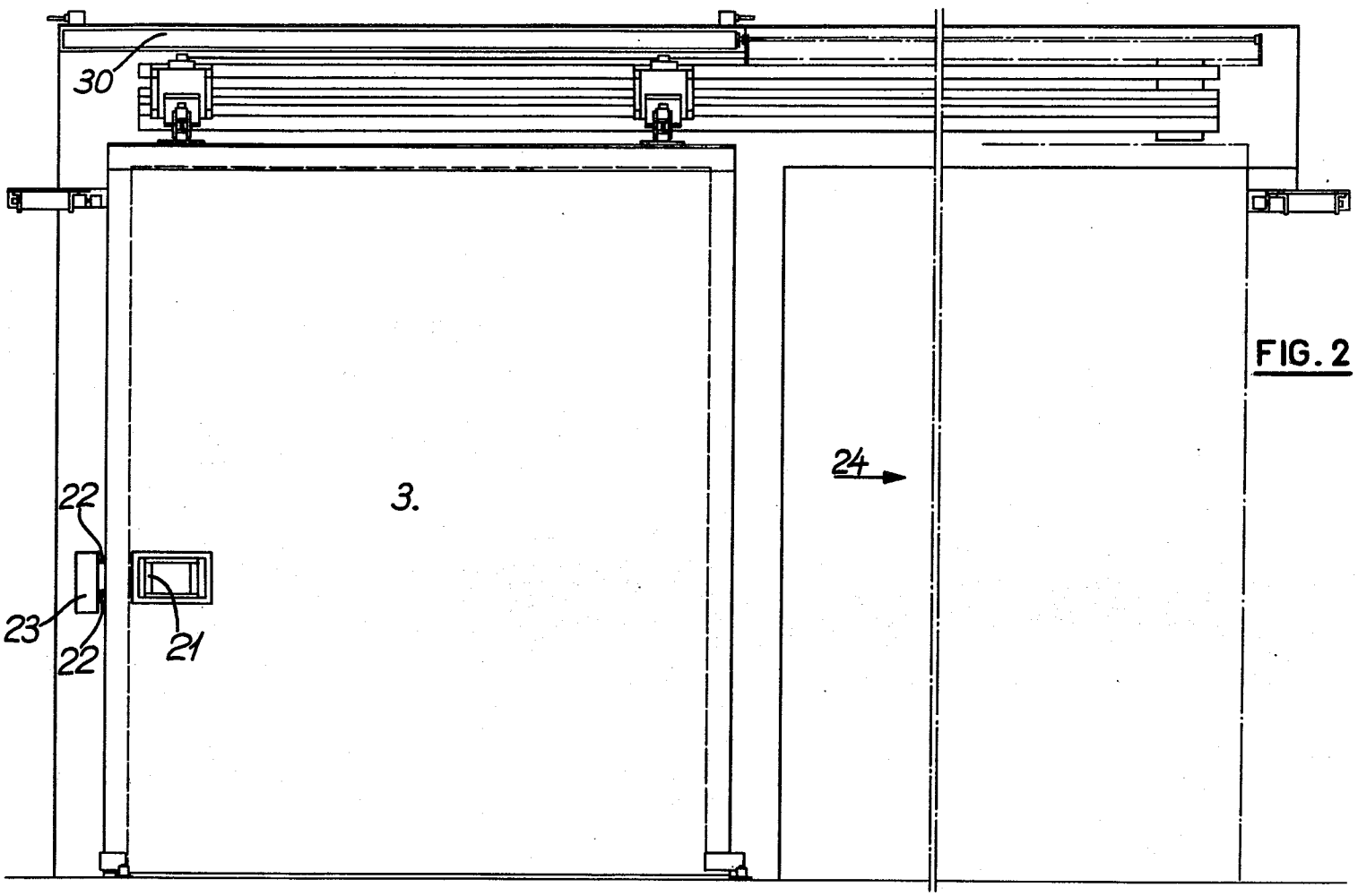
FIG. 2 is a front elevation of the first embodiment.
Figure 3:
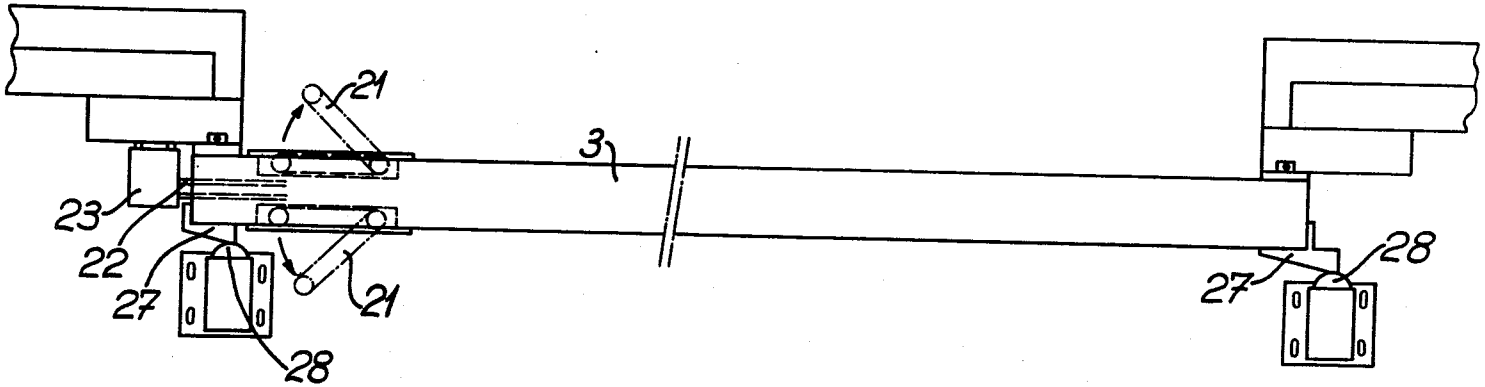
FIG. 3 is a plan view of the lower part of the first embodiment.

The door can be provided with one or more of the described suspending devices of FIG. 1, according to its dimensions and its weight, two such devices being shown in FIG. 2.

Figure 4:
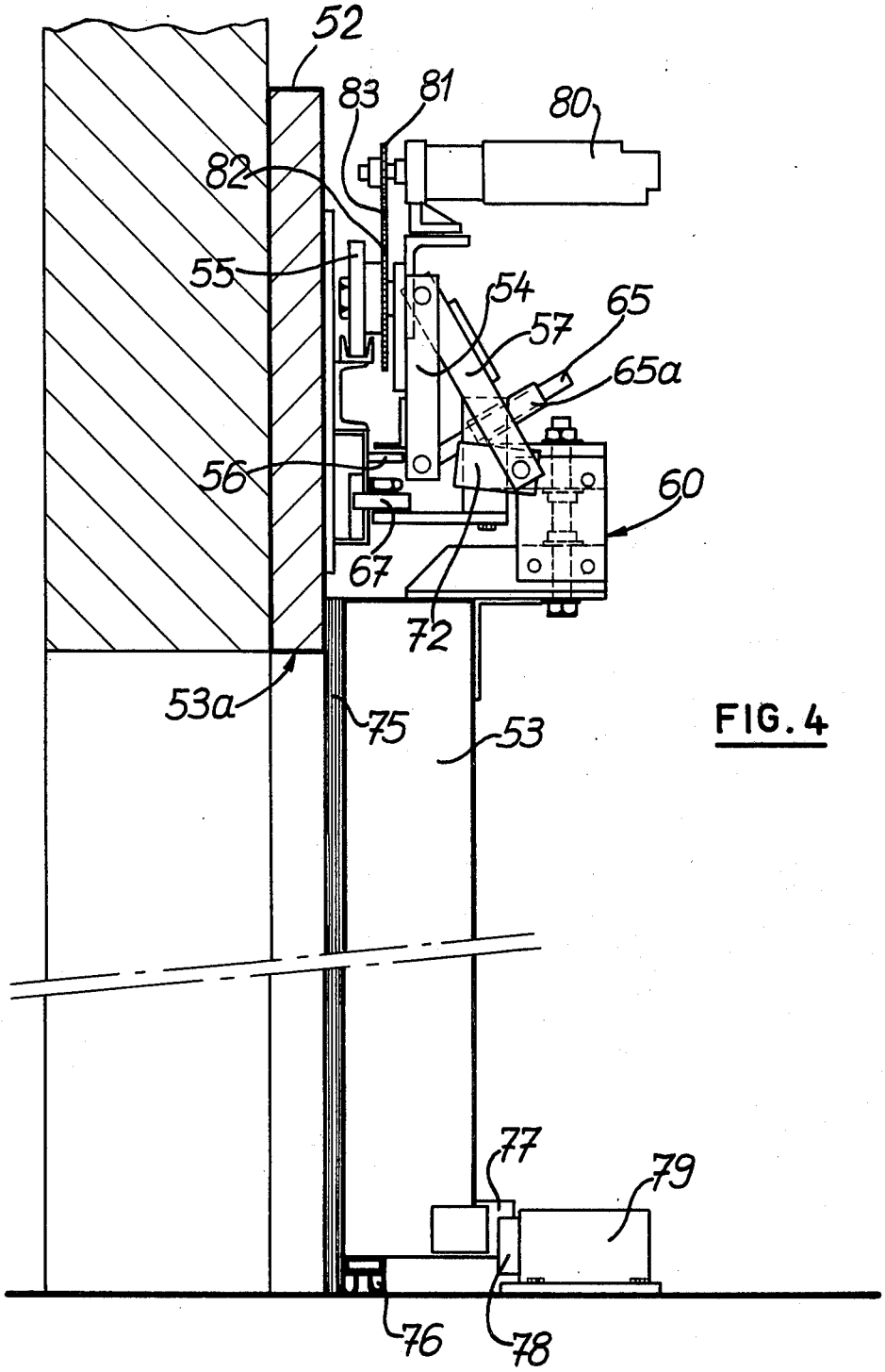
FIG. 4 is a side elevation of a second embodiment.
Figure 5:
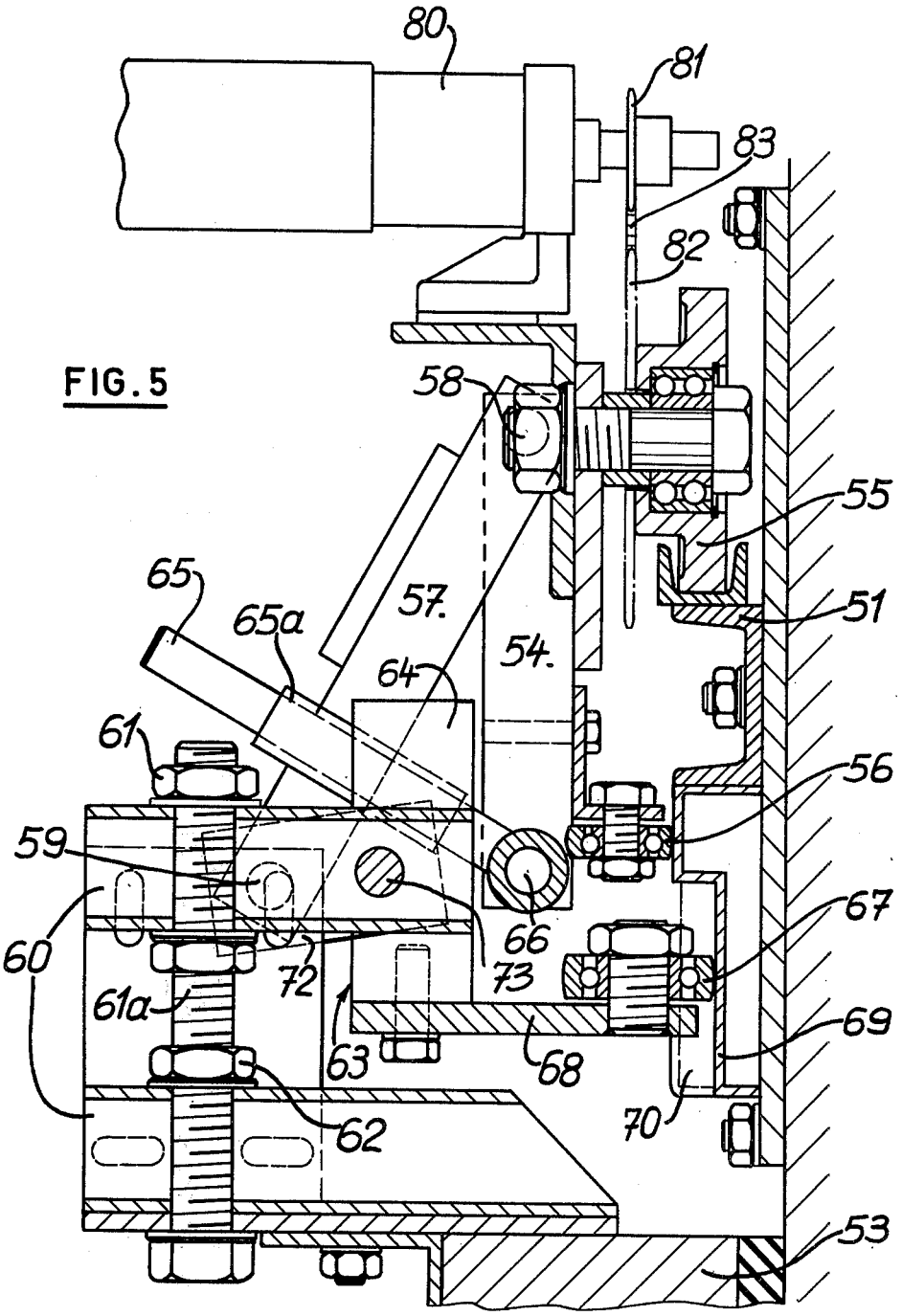
FIG. 5 is a cross-section showing part of FIG. 4 on an enlarged scale.

The door-suspending device shown in FIGS. 4 and 5 includes a horizontal rolling track 51 which is fixed parallel to the door frame 52 having a door opening 53*a*.

A door-suspension member 54 can move along the rolling track 1 by means of a suspension roller 55 and a lateral bearing roller 56. The door 53 is suspended from this member 54 by a pair of levers 57.

Levers 57 are pivotally connected at 58 to member 54 and at 59 to an adjusting unit 60 fixed on door 53. This adjusting unit 60 enables, by means of nuts 61 mounted on a bolt 61*a*, adjustment of the height of the door 53 above the ground and, by means of nuts 62, adjustment of the spacing of door 53 relative to its frame, and its verticality.

To raise the door 53 and separate it from its frame 52 during opening, there is provided a toggle-joint mechanism 63 adapted to transmit movement of a roller 67. The roller 67 is mounted on a horizontal arm 68 carrying vertical plates 64, and is adapted to cooperate with a translation cam 69 provided on a rolling track 70 for this roller 67. The toggle-joint mechanism 63 includes a pair of linkage plates 72 each pivoted at one end about a pin 73 carried by a respective plate 64 and at the other end to the respective lever 57 at 59. Plates 64 each carry an inclined tube 65*a* slidably receiving a rod 65 pivotally connected to member 54 at 66.

The operation of this device is similar to that described in the previous embodiment; however opening takes place by means of a pneumatic or electric rotary motor 80 which by its pinion 81 and chain 83 drives a toothed wheel 82 integral with roller 55, this roller 55 thus assuming a driving function. When the closed door 53 is driven by the driving roller 55, the roller 67 moves up on cam 69. This movement is transmitted by the toggle-joint mechanism 63 and the door 53 is moved away from its frame and simultaneously raised above the ground. In this manner sealing joints 75 and 76 are respectively moved away from the frame and the ground, and the door 53 is free to slide. The roller 67 then rolls along its rolling track 70 and the door is thus held raised and spaced apart from the frame all the way along its path.

Upon moving the door in the opposite direction into its closed position, the roller 67 falls back into cam 69; the door follows a trajectory opposite that during opening; it is lowered and simultaneously comes to apply against its frame.

To assist holding of the door against its frame, there are provided on the lower part of the door two cams 77 having plane operative faces cooperating with rollers 78 turning in housings 79 secured on the ground, in a manner to strongly apply the door against the frame in the closed position.

According to its dimensions and weight, the door will be provided with one or several of these suspending devices.

What is claimed is:

1. A sliding door assembly comprising a door, a door frame having a door opening, a horizontal rolling track fixed parallel to the frame above said door opening, a suspension member movably mounted along the track, a lever pivotally connected at its upper end to said suspension member and at its lower end to the upper portion of the door and by which the door is suspended from the track, the lever being pivotable between a first position in which the door is lowered and applied against the frame and a second position in which the door is raised and spaced apart from the frame, and means for moving the lever from its second to its first position in response to movement of said suspension member along the track into a closed position of the door and from its first to its second position in response to movement of said suspension member along the track from said closed position of the door, said means for moving said lever comprising a cam track fixed in relation to the frame, linkage means pivotally connected with the lower end of said lever and comprising a movable cam follower member, a roller carried by said cam follower member and engageable with said cam track to pivot said lever from said first position to said second position and means for guiding said cam follower member to move obliquely upwardly and outwardly from said frame.

2. A sliding door assembly according to claim 1, in which said guiding means comprises an inclined passage in said cam follower member and a rod pivotally mounted on said suspension member and slidably received in said passage.

3. A sliding door assembly according to claim 1, in which said suspension member is movably mounted on the track by rollers and in which a motor is connected to at least one of said rollers to drive said roller and thereby move the suspension member and the door along the track.

4. A sliding door assembly according to claim 3, in which one of said rollers has its axis horizontal and another of said rollers has its axis vertical.

5. An assembly as claimed in claim 3, in which the motor is a rotary pneumatic motor.

6. An assembly as claimed in claim 3, in which the motor is a rotary electric motor.

7. A sliding door assembly comprising a door, a door frame having a door opening, a horizontal rolling track fixed parallel to the frame above said door opening, a suspension member movably mounted along the track, a door supporting unit mounted at the top of said door, a lever pivotally connected at its upper end to said suspension member and at its lower end to said door supporting unit whereby the door is suspended from said suspension member for movement along the track, said lever being pivotable between a first position in which the door is lowered and applied against the frame and a second position in which the door is raised and spaced from the frame, and means for moving the lever from its second to its first position in response to movement of the door along the track into closed position and from its first to its second position in response to movement of the door along the track from said closed position to open position, said means for moving said lever comprising a cam track fixed in relation to the frame, linkage means pivotally connected with said door supporting unit and comprising a movable cam follower member, a roller carried by said cam follower member and engageable with said cam track to pivot said lever from said first position to said second position and means for guiding said cam follower member to move obliquely upwardly and outwardly from said frame while restraining any swinging movement of the door.

8. A sliding door assembly according to claim 7, in which said cam follower member is pivotally connected with said door supporting unit and said guiding means comprises an inclined guideway on said cam follower member and a rod pivotally mounted on said suspension member and slidably received in said guideway.

9. A sliding door assembly according to claim 7, in which a pivoted link connects said cam follower member with said door supporting unit and in which said guiding means comprises an inclined guideway on said cam follower member and a rod pivotally mounted on said suspension member and slidably received in said guideway.

10. A sliding door assembly according to claim 7, comprising means for adjustably positioning said door with respect to said door supporting unit to position said door with respect to said door opening and tightly against the frame when said lever is in its first position.

* * * * *

UNITED STATES PATENT OFFICE

CERTIFICATE OF CORRECTION

PATENT NO. : 3,947,999

DATED : April 6, 1976

INVENTOR(S) : Pierre DISERENS

It is certified that error appears in the above-identified patent and that said Letters Patent are hereby corrected as shown below:

On the title page in column 1, Item [76], line 1 delete "Disperens" and insert --Diserens--.

Signed and Sealed this

Twenty-first Day of December 1976

[SEAL]

*Attest:*

RUTH C. MASON
*Attesting Officer*

C. MARSHALL DANN
*Commissioner of Patents and Trademarks*